US007721457B2

(12) United States Patent
Brady

(10) Patent No.: US 7,721,457 B2
(45) Date of Patent: May 25, 2010

(54) APPARATUS FOR PREPARING MATERIAL PIECES TO BE SEWN

(76) Inventor: John R. Brady, 20041 Osterman Rd. #R4, Lake Forest, CA (US) 92630

( * ) Notice: Subject to any disclaimer, the term of this patent is extended or adjusted under 35 U.S.C. 154(b) by 119 days.

(21) Appl. No.: 12/105,537

(22) Filed: Apr. 18, 2008

(65) Prior Publication Data

US 2008/0263884 A1 Oct. 30, 2008

Related U.S. Application Data

(60) Provisional application No. 60/913,877, filed on Apr. 25, 2007.

(51) Int. Cl.
*B43L 7/033* (2006.01)
*A41H 3/01* (2006.01)

(52) U.S. Cl. ..... 33/562

(58) Field of Classification Search ..... 33/562, 33/2 R, 11, 17 R

See application file for complete search history.

(56) References Cited

U.S. PATENT DOCUMENTS 403,404 A * 5/1889 Yates ..... 33/11
1,011,915 A * 12/1911 Carbonara ..... 33/11
4,642,896 A * 2/1987 Grimm ..... 33/17 R
4,945,642 A * 8/1990 Saulietis ..... 33/17 R
5,090,129 A * 2/1992 Cunningham ..... 33/481
5,579,670 A * 12/1996 McCormick ..... 83/56
5,749,149 A * 5/1998 Claytor ..... 33/1 F
6,276,070 B1 * 8/2001 Hawley ..... 33/563
6,473,982 B1 * 11/2002 Schimes ..... 33/562
7,086,171 B2 * 8/2006 Lawson ..... 33/562
7,194,970 B2 * 3/2007 Srebro ..... 112/475.08
7,568,295 B1 * 8/2009 Strain ..... 33/566
2004/0163269 A1 * 8/2004 Brady ..... 33/562

* cited by examiner

*Primary Examiner*—Christopher W Fulton

(57) ABSTRACT

An apparatus for preparing material pieces to be sewn together includes a planer structure including a top surface, a bottom surface, a first end and a first and second edge. The first edge includes a first lip extending a first distance below the bottom surface where an edge of the material aligns with and touches the first lip and the material can be marked along the second edge. The second edge further includes a second lip extending the first distance below the bottom surface for holding the material to a flat surface. The first end is broadened and includes a third edge at an acute angle to the second edge. The third edge includes a third lip extending the first distance below the bottom surface where the material having the acute angle aligns with and touches the third lip and the dog ear of the material can be trimmed.

20 Claims, 4 Drawing Sheets

APPARATUS FOR PREPARING MATERIAL PIECES TO BE SEWN

CROSS-REFERENCE TO RELATED APPLICATIONS

The present Utility patent application claims priority benefit of the U.S. provisional application for patent Ser. No. 60/913,877 filed on Apr. 25, 2007 under 35 U.S.C. 119(e) and entitled "Tool for preparing quilt pieces to be sewn together". The contents of this related provisional application are incorporated herein by reference for all purposes.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to crafting tools. More particularly, the invention relates to a tool that enables a user to measure, mark and trim pieces of material for use in crafting.

BACKGROUND OF THE INVENTION

The present invention relates in general to a tool that aids in forming and marking pieces of material that are used in crafts such as, but not limited to, quilting or scrap booking so that the pieces of material can be easily shaped and accurately joined together.

Common problems quilters experience include sewing consistently accurate seam allowances and trimming points when the material is formed to include acute angles such as, but not limited to, forty-five degree angles. It can also be difficult to accurately align two pieces of material to be sewn together when the pieces of material include different angles. Another problem quilters experience is that they must start and stop sewing exactly where the seam lines cross when joining one piece with two others that form an acute angle, commonly referred to as a set-in-seam.

The most common seam allowance recommended by those skilled in the art of quilting is one to two thread widths less than one-quarter inch, commonly known as a scant quarter inch. To measure and mark accurate scant quarter inch seam allowances quilters generally use the lines on a ruler. There are many problems that can lead to inaccurate and/or inconsistent measuring or marking of scant quarter inch seam allowances. For example, without limitation, since rulers are designed for measuring, they have multiple lines, none of which mark the scant quarter inch that quilters need. Also, the quilter must repeatedly find the right line on the ruler and then determine where to line the edge of the fabric up relative to the line for a scant quarter inch and do that consistently for every piece. Another problem with rulers is that a line does not give a definite point with which to line up the mark. Users can line up to the inside, outside or right in the middle of a line, all of which can seem correct.

Common tools for point trimming include individual point trimmers with lines printed on them to act as guides for accurately lining up material to trim points. There are also individual templates, one each for trimming the points off half and quarter square triangles. There are also tools for the set-in-seam problem. One tool uses lines as guides, and another tool is formed with several angles. Both include holes to mark where the seam lines should intersect. Having multiple lines or angles on one tool or needing multiple tools for the same job is confusing and adds to the number of tools the user must manage. Current tools are also limited to the number of lines printed on them or the angles into which they are formed.

In view of the foregoing, there is a substantial need for an easily handled tool that combines all of the aforementioned features and that assist in marking and trimming pieces of material so the pieces of material can be easily and accurately joined together.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a top view, and FIG. 1B is a cross sectional view;

FIG. 3A is a top view, and FIG. 3B is a cross sectional view;

Figure 1A:
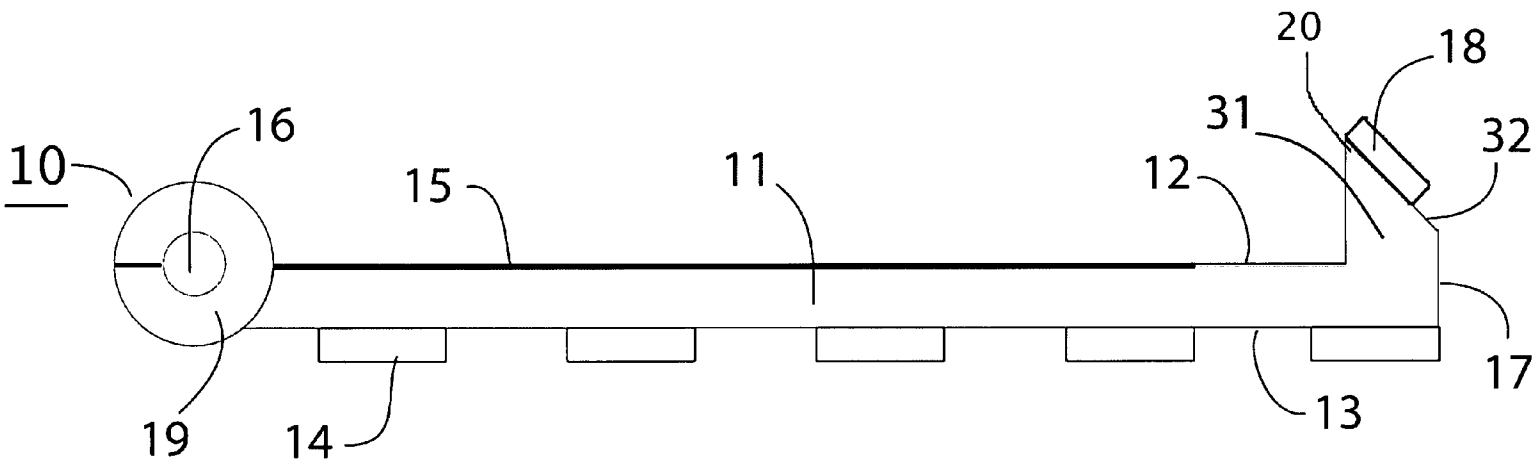
FIGS. 1A and 1B illustrate an exemplary tool for preparing pieces of material to be sewn together, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an apparatus for preparing material pieces to be sewn is presented.

In one embodiment, an apparatus for preparing material pieces to be sewn together is presented. The apparatus includes a planer structure including a top surface, a bottom surface, a first end, a first edge perpendicular to the first end, a second edge perpendicular to the first end and a first width extending from the first edge to the second edge having a dimension of a width for a desired seam allowance. The first edge includes a first extension extending a first distance below and perpendicular to the bottom surface to form a first lip below the bottom surface where, when the apparatus is placed on a flat surface, the material can be placed between the bottom surface and the flat surface such that an edge of the material aligns with and touches the first lip providing a tactile feedback that the material is aligned. The desired seam allowance can be marked on the material along the second edge. The first end extends away from and perpendicular to the second edge and including a third edge at an acute angle to the second edge. The third edge includes a third extension extending the first distance below and perpendicular to the bottom surface to form a third lip below the bottom surface where, when the apparatus is placed on a flat surface, the material can be placed between the bottom surface and the flat surface such that an angled edge of the material aligns with and touches the third lip and a portion of the material extending beyond the first end can trimmed. In another embodiment, the second edge further includes a second extension extending the first distance below and perpendicular to the bottom surface to form a second lip below the bottom surface where, when the apparatus is placed on a flat surface, the material can be placed between the bottom surface and the flat surface and the second lip holds the material to the flat surface. In other embodiments the first and second extensions extend a second distance above the top surface and the first and second distances are equal. In another embodiment the first extension is intermittently spaced along the first edge thereby creating a plurality of extensions and spaces in between where the material can be viewed aligning with and touching the extensions. In various other embodiments the first extension has a width greater than the second extension, the desired seam allowance is a common width of seam allowance used in quilting, the planer structure further includes a hole in a second end and the planer structure includes a transparent material to facilitate viewing the material.

In another embodiment, an apparatus for preparing material pieces to be sewn together is presented. The apparatus includes a planer structure including a top surface, a bottom surface, a first end and a first and second edge. The first edge includes a first lip extending a first distance below the bottom surface where an edge of the material aligns with and touches the first lip and the material can be marked along the second edge. The first end is broadened and includes a third edge at an acute angle to the second edge. The third edge includes a third lip extending the first distance below the bottom surface where the material having the acute angle aligns with and touches the third lip and the dog ear of the material can be trimmed. In other embodiments the second edge further includes a second lip extending the first distance below the bottom surface for holding the material to a flat surface, the first and second lips extend a second distance above the top surface and the first and second distances are equal. In yet another embodiment the first lip is intermittently spaced along the first edge thereby creating a plurality of lips and spaces in between where the material can be viewed aligning with and touching the extensions. In other embodiments the planar structure further includes a width extending from the first edge to the second edge having a dimension of a width for a desired seam allowance and the desired seam allowance is a common width of seam allowance used in quilting. In still other embodiments, the first lip has a width greater than the second lip and the planer structure further includes a hole in a second end.

In another embodiment, an apparatus for preparing material pieces to be sewn together is presented. The apparatus includes a planer structure including a top surface, a bottom surface, a first edge including means for providing a first lip, a second edge, a broadened end including means for providing a third edge and a third lip. In still another embodiment the second edge further includes means for providing a second lip.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

The preferred embodiment of the present invention provides a tool that may be used as a seam allowance measurer and marker and a point-trimmer. The preferred embodiment is sized to enable users to measure an accurate scant quarter inch for seam allowances. Alternate embodiments may be sized to enable users to measure various other distances for seam allowances such as, but not limited to, a full quarter inch, a scant eighth of an inch, a full eighth of an inch, five eighth of an inch etc. The preferred embodiment enables a user to simply, clearly and precisely line the edge of a piece of material up to the tool for accurate seam measurements and marking without making the user pick one set of markings out from others or having to align the edge of the material with a mark at all. The preferred embodiment also enables a user to easily mark seam intersections at any angle rather than being limited to those marked or formed on the tool as in conventional measuring/marking tools.

Figure 1B:
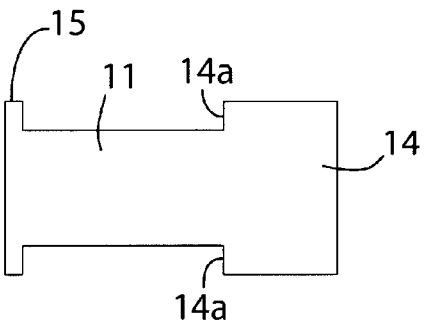

FIGS. 1A and 1B illustrate an exemplary tool 10 for preparing pieces of material to be sewn together, in accordance with an embodiment of the present invention. FIG. 1A is a top view, and FIG. 1B is a cross sectional view. In the present embodiment tool 10 is preferably formed of transparent material such as, but not limited to, plastic or acrylic. However, in some embodiments the tool may also be formed of opaque material such as, but not limited to, metal or wood. In the present embodiment, tool 10 comprises a planar structure 11 with two surfaces, a straight edge 12, a guide edge 13, a broadened end 17, and a rounded end 19. Guide edge 13 includes at least one guide 14 that is formed into or attached to guide edge 13 so that guides 14 extend beyond guide edge 13 of planar structure 11. Guides 14 are thicker than the thickness of planar structure 11. Referring to FIG. 1B, in the present embodiment, guide 14 is centered on guide edge 13 of planar structure 11 thereby forming lips 14*a* that are even with and parallel to guide edge 13 of planar structure 11 and that extend beyond both surfaces of planar structure 11. In alternate embodiments guides may be formed so that the guides are even with one surface of the planar structure thereby extending beyond the other surface of the planar structure forming a single lip that is even with and parallel to the guide edge of the planar structure, for example, without limitation, in the embodiment shown by way of example in FIG. 2. Referring to FIG. 1A, guides 14 can be formed or attached to planar structure 11 so that guides 14 are intermittent along guide edge 13 leaving space in between guides 14 thereby giving the user a better view of material that is lined up to lips 14*a* of extensions 14 and therefore aligned with guide edge 13.

In the preferred embodiment, planar structure 11 is a scant quarter-inch wide, which is 10 to 20 thousandths of an inch less than a quarter-inch, from straight edge 12 to guide edge 13 and approximately one-eighth inch thick, and guides 14 are approximately one-half inch in length, approximately one-eighth inch wide, approximately three-sixteenths of an inch thick and separated by approximately one half inch from each other. It will be appreciated that planar structure 11 and guides 14 may be of different measurements in alternate embodiments than those given in the preferred embodiment without exceeding the scope or spirit of the present invention.

Figure 2:
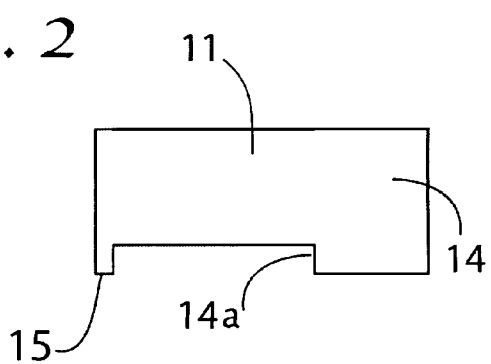
FIG. 2 is a cross sectional view of an exemplary tool for preparing pieces of material to be sewn together, in accordance with an embodiment of the present invention.

Referring to FIG. 1A, straight edge 12 of planar structure 11 is substantially straight. In the present embodiment, tool 10 comprises a narrow raised strip 15 along most or all of straight edge 12 that extends from one or both surfaces of planar structure 11 and is even with, parallel to and not extending beyond straight edge 12. Referring to FIG. 1B and FIG. 2, narrow raised strip 15 extends the same distance beyond one or both surfaces of planar structure 11 as guides 14. This enables the lower surface of planar structure 11 to be slightly above and parallel to a flat surface when tool 10 is used with guides 14 and narrow raised strip 15 down on the flat surface. It is contemplated that this space between the lower surface of planar structure 11 and the flat work surface will make it possible to line a piece of material up to lips 14*a* on guides 14 and narrow raised strip 15 will hold the material in place when the user holds the present embodiment down on the flat work surface after lining tool 10 up to the material. Alternate embodiments may not comprise a narrow raised strip along the straight edge. These embodiments may be particularly useful when working with thicker materials since it is contemplated that the bottom surface of the planar structure will be able to lay flat on the material when the guides are in contact with the work surface.

In the present embodiment, broadened end 17 of planar structure 11 enables a user to trim points from pieces of material. Those skilled in the art of quilting will recognize that it is often necessary to cut off the excess material, or points, created when the material is cut so that two adjacent edges form an acute angle. Broadened end 17 of planar structure 11 is broadened to match the width of a piece of material, from edge to edge, at the distance and angle from the vertex of an acute angle where the material should be trimmed to remove the correct amount of excess material, or point. In the preferred embodiment shown by way of example in FIG. 1A, the width of broadened end 17 of planar structure 11 is three-eighths of one inch. This is the width of the material, from edge to edge, at the correct distance and angle from the vertex of a forty-five degree acute angle where the material should be trimmed to remove the correct amount of excess material, or point. However, alternate embodiments may comprise broadened ends of various widths, depending on the size and angle of the material being trimmed.

Referring to FIG. 1A, the present embodiment also comprises an extension 31 from straight edge 12 at broadened end 17 of planar structure 11. Extension 31 is the same thickness as planar structure 11 and is formed to include a straight edge 32 that extends outward and back from a point 20 on broadened end 17 of planar structure 11 farthest from guide edge 13 of planar structure 11. Straight edge 32 forms an angle with straight edge 13. More specifically, in the present embodiment straight edge 32 forms an acute angle with both edge 12 and 13; however, the material is aligned with edge 13 of planar structure 11, which matches the acute angle of the material from which a user wishes to trim a point. Extension 31 includes a guide 18 that extends from straight edge 32 of extension 31 that matches the thickness and placement, relative to the surfaces of the planar structure 11, of guides 14 thereby creating a lip that extends beyond one or both surfaces of extension 31 that is even with and parallel to straight edge 32 of extension 31. In the preferred embodiment shown by way of example in FIG. 1A, the angle that straight edge 32 forms with guide edge 13 of planar structure 11 is forty-five degrees, the acute angles of right isosceles triangles commonly used in quilting. It will be appreciated that in alternate embodiments the tool may be formed to trim the points of various other angles such as, but not limited to, sixty or thirty degrees by making the broadened end of the planar structure the correct width and the straight edge of the extension the correct angle to accurately trim points from acute angles other than those given in the preferred embodiment without exceeding the scope or spirit of the present invention.

Referring to FIG. 1A, rounded end 19 of planar structure 11 comprises a hole 16. Hole 16 may have other purposes in other embodiments of the invention; however in the present embodiment hole 16 is principally a hang-hole or used to attach a lanyard]

FIG. 2 is a cross sectional view of an exemplary tool for preparing pieces of material to be sewn together, in accordance with an embodiment of the present invention. The tool is similar in structure to the embodiment shown by way of example in FIG. 1A and comprises a planar structure 11, a guide 14 and a narrow raised strip 15. In the present embodiment, guide 14 and narrow raised strip 15 extend from a bottom surface of planar structure 11 and are even with a top surface of planar structure 11.

Figure 3A:
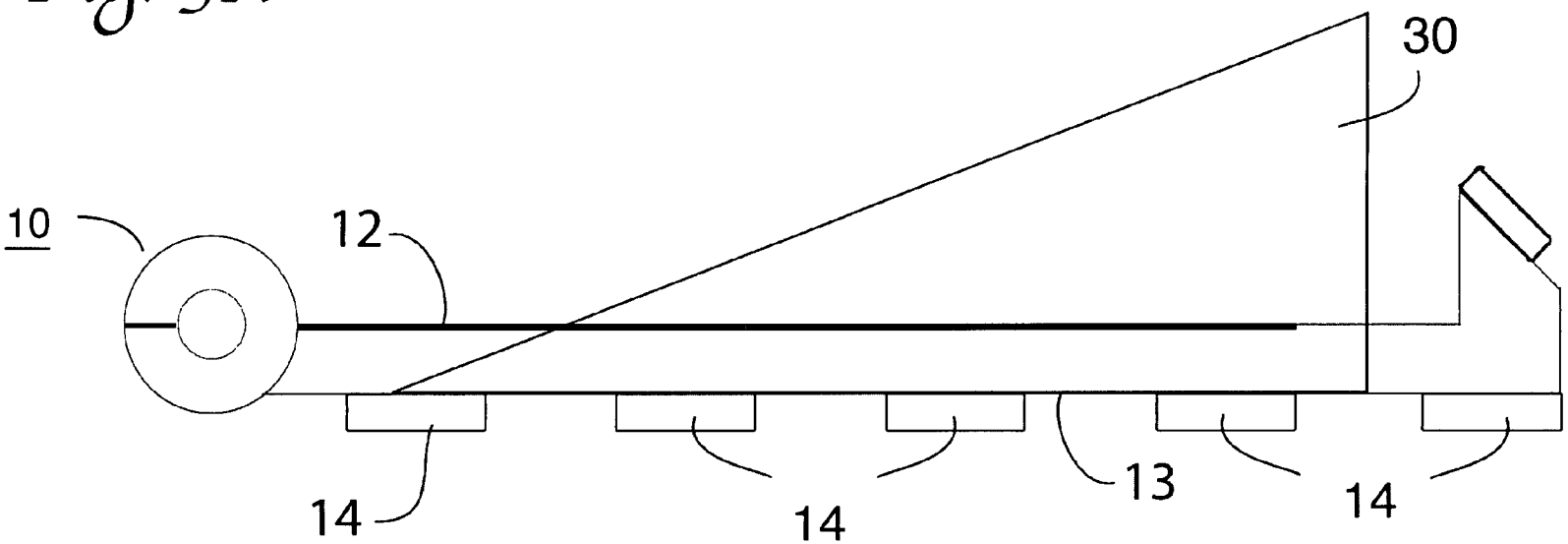
FIGS. 3A and 3B illustrate an exemplary tool for preparing pieces of material to be sewn together in use, in accordance with an embodiment of the present invention.
Figure 3B:
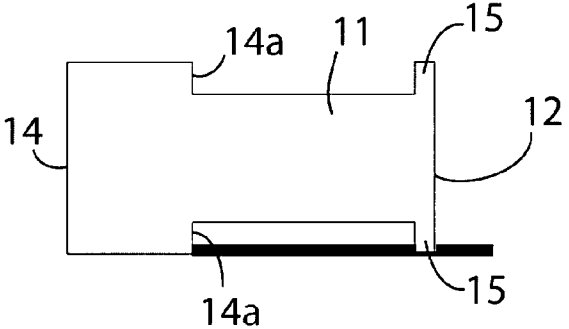

FIGS. 3A and 3B illustrate an exemplary tool 10 for preparing pieces of material to be sewn together in use, in accordance with an embodiment of the present invention. FIG. 3A is a top view, and FIG. 3B is a cross sectional view. In typical use of the present embodiment, a user places a piece of material 30 on a flat work surface. The user then angles tool 10 so a narrow raised strip 15 of a straight edge 12 of a planar structure 11 is pointed away from the user. The user then slides tool 10 towards the edge of material 30 to be marked so straight edge 12 is above the upper surface of material 30 and slides guide edge 13 on the flat surface towards the edge of material 30. When lips 14*a* on guides 14 are aligned with and touching the edge of material 30, the user lowers straight edge 12 of planar structure 11 with narrow raised strip 15 down onto the surface of material 30.

Since lips 14*a* on guides 14 are aligned with guide edge 13 and narrow raised strip 15 is aligned with straight edge 12, the distance from the edge of the material to straight edge 12 is the width of planar structure 11, which, if the user is using a tool of the correct size, should be the desired seam allowance. Lips 14*a* enable the user to feel the contact of the edge of material 30 with tool 10 rather than relying on lines or edges of the tool that must be lined up by sight alone as in conventional measuring tools. Tool 10 can be aligned with a straight edge of a single piece of material or two or more pieces of material to be sewn together. Once tool 10 is properly aligned with the edge of material 30, the user may use a marking device such as, but not limited to, a fabric marker to draw a line on material 30 along straight edge 12 of planar structure 11, marking exactly where the user should sew. The combination of lips 14*a* creating a precise edge on which to align the edge of material 30 and the width of planar structure 11, being the exact measurement required for the seam allowance enables a user to easily measure or mark accurate and consistent seam allowances.

In an alternate application, the user can measure to see if an accurate seam allowance has been sewn on pieces of material after the pieces of material have been joined. To do this the user positions tool 10 on the material in the same manner described for marking the material. When tool 10 is in place, the user compares the stitching on the material to straight edge 12. If the material has been sewn correctly, the user will see the stitching along straight edge 12.

Another contemplated use of embodiments of the present invention is trimming off the excess points of material formed near the vertex of acute angles known to those skilled in the art as dog-ears. Many of the shapes of material that quilters cut to make a quilt, such as, but not limited to, triangles and parallelograms, include acute angles. Near the vertex of acute angles there is typically extra material that should be trimmed away before or after the piece of material is sewn to another piece of material. This excess material also makes it difficult to see how to align these pieces of fabric to be sewn together. The points, or dog-ears, often make it so the edges of two pieces of fabric do not line up exactly with each other even when the pieces are accurately aligned to be sewn together. Using an embodiment of the present invention to trim off the excess material enables the edges to line up precisely when the pieces of material are accurately aligned for sewing.

Figure 4:
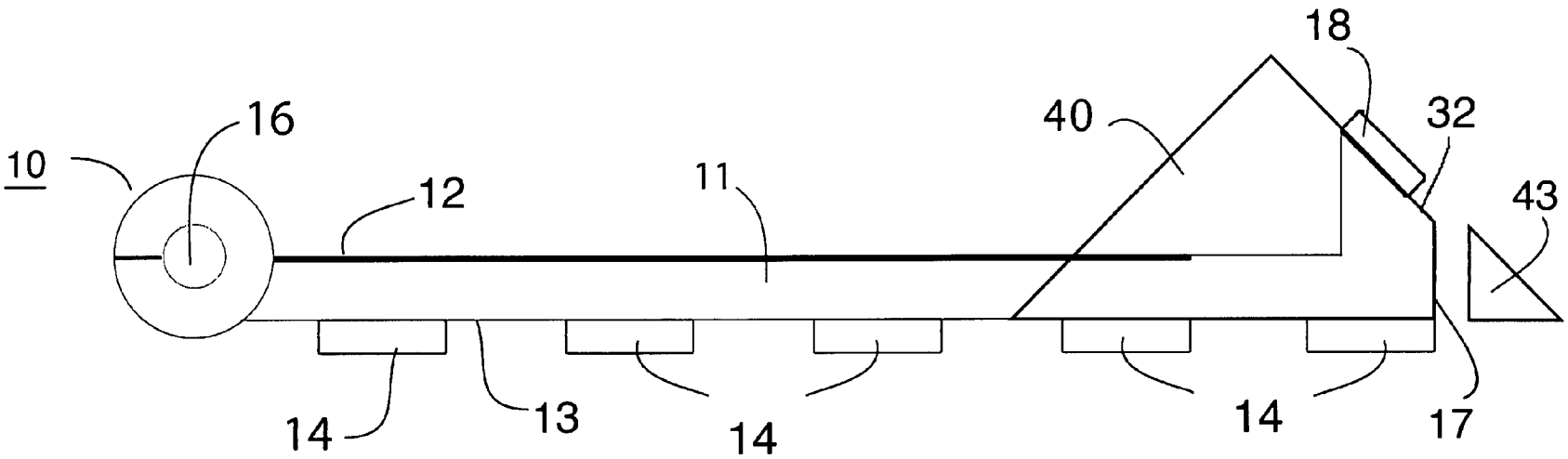
FIG. 4 is a top view of an exemplary tool for preparing pieces of material to be sewn together being used to trim a point from a piece of material, in accordance with an embodiment of the present invention.

FIG. 4 is a top view of an exemplary tool 10 for preparing pieces of material to be sewn together being used to trim a point 43 from a piece of material 40, in accordance with an embodiment of the present invention. To measure point 43 to be trimmed from material 40, a broadened end 17 of a planar structure 11 of tool 10 is sized so that broadened end 17 is the same width as the width of material 40 where material 40 should be trimmed to remove point 43. Broadened end 17 of planar structure 11 is perpendicular to the elongate sides of planar structure 11, which are a straight edge 12 and a guide edge 13. In the preferred embodiment broadened end 17 is three-eighths of an inch wide, which is the width of a piece of material at the correct distance and angle from the vertex of a forty-five degree angle to remove the dog-ears. In typical use of the present embodiment, the user aligns lips formed by guides 14 on guide edge 13 of planar structure 11 with an edge of material 40 that forms the forty-five degree angle. Broadened end 17 of planar structure 11 is located near the forty-five degree angle of material 40. Keeping one edge of material 40 aligned to the lips of guides 14, the user then adjusts tool 10 until broadened end 17 of planar structure 11 overlaps a width material 40 that is exactly the same width as broadened end 17 from edge to edge. The user may then mark or trim the fabric along broadened end 17 of planar structure 11.

Referring to FIG. 4, broadened end 17 of planar structure 11 comprises an edge 32 that extends inward towards the middle of planar structure 11 at a forty-five degree angle away from broadened edge 17. Edge 32 starts at the end of broadened end 17 opposite guide edge 13 of planar structure 11 with guides 14 that form lips. There is a similar guide 18 that forms a lip from edge 32. The lip of guide 18 matches the angle and position of the adjacent edge of material 40 that forms the forty-five degree angle when the lips of guides 14 are aligned with the other edge of material 40 creating the forty-five degree angle as previously described. It is contemplated that aligning material 40 with the edges of the lips of guides 14 along guide edge 13 of planar structure 11 and the lip of guide 18 along edge 32 is easier than using lines or template edges to align material 40 and accurately trim point 43. It will be appreciated that in alternate embodiments the width at the broadened end of the planar structure and the angle of the angled extension can be formed to match the width and angle needed to trim the dog-ears off of acute angles other than forty-five degrees such as, but not limited to, sixty and thirty degree angles.

Figure 5:
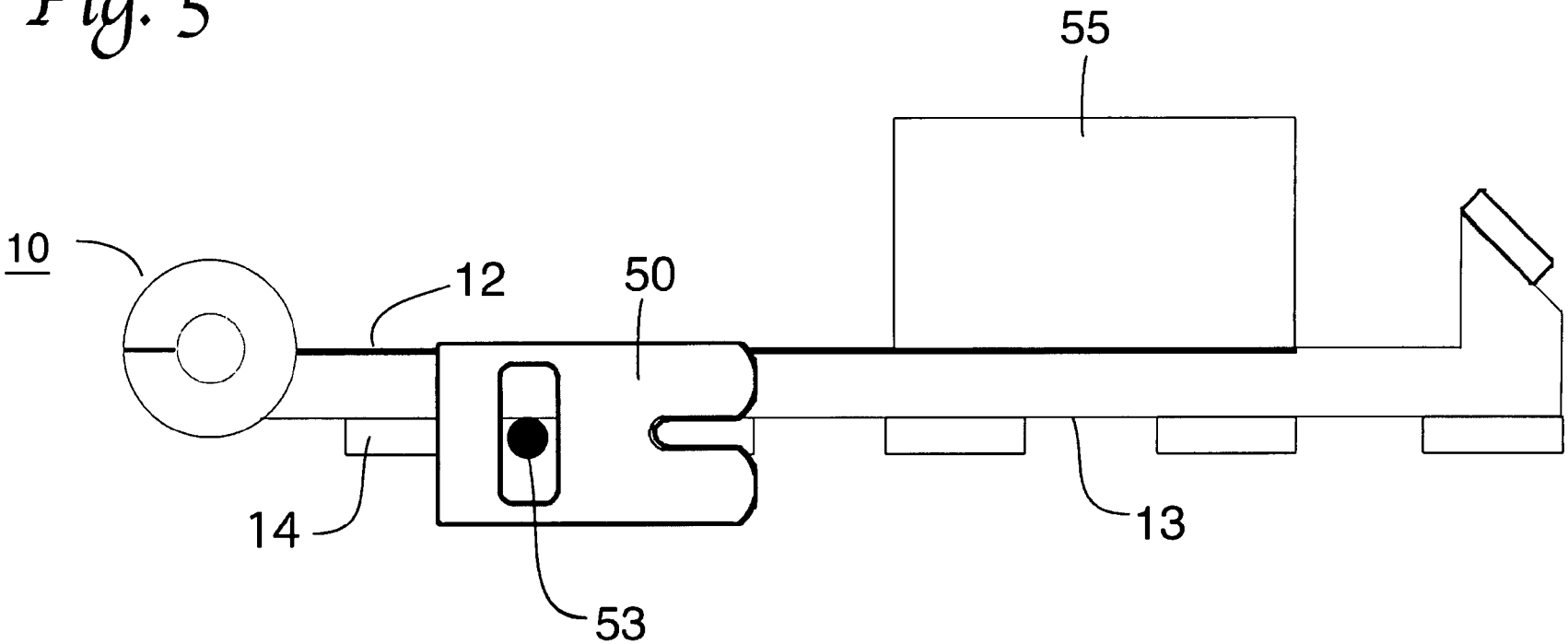
FIG. 5 is a top view of an exemplary measuring tool being used to align a seam guide on a sewing machine, in accordance with an embodiment of the present invention.

FIG. 5 is a top view of an exemplary measuring tool 10 being used to align a seam guide on a sewing machine, in accordance with an embodiment of the present invention. To accurately align a seam guide on a sewing machine using the present embodiment, a user raises a presser foot 50 and lowers a needle 53 on the sewing machine. The user then slides tool 10 under presser foot 50 so that a guide edge 13 rests against needle 53. The user can position tool 10 so that the needle 53 is in one corner formed by guide edge 13 and one edge of a guide 14 to give it additional stability. Once tool 10 is aligned straight, the user may then set the seam guide on the sewing machine if available or place a marker 55 such as, but not limited to, a piece of tape on the sewing machine along a straight edge 12 of tool 10. The user may now sew the correct seam allowance using the machine by aligning the edge of a piece of material along marker 55 while sewing.

Being able to accurately mark seam allowances and points where they intersect also enables embodiments of the present invention to be useful for marking seam lines before sewing when you need to avoid crossing one seam line with another. This is common in quilting such as for binding corners and mitered corners where you need to stop one seam width from the edge of the quilt you are binding. Another is when one piece of material must be joined to two adjacent edges of two other pieces of material that form an acute angle. This is commonly known as a set-in-seam.

It is generally very difficult to align pieces of material to be sewn together when these pieces of material include different angles. The edges of these pieces of material often are not the same length and do not line up in an obvious way, such as, but not limited to, end-to-end along an edge. Using an embodiment of the present invention to mark the seam lines and the points where the seam lines intersect on both pieces of material enables the accurate alignment of pieces of material before sewing these pieces of material together. If a user uses an embodiment of the present invention to mark the seam line on two adjacent edges of a piece of material that have been cut into a desired shape, the lines should intersect at a point where the seam lines should cross each other. By marking lines on three adjacent sides of a piece of material, a user will be able to create one point near each corner of the middle marked edge where the lines intersect. If the edges of two pieces of material that are to be sewn together are marked this way, it is contemplated that the two intersecting points on the edge of one piece of material will line up with the two intersecting points of the other piece of material when the pieces of material are accurately aligned to be sewn together. The user can then simply align the seam lines and the points where the seam lines cross to generally ensure accurate alignment.

Once the pieces of material are accurately aligned, these pieces of material may still come out of alignment when being sewn together. Since a sewing machine has feed dogs that grab the material below and a presser foot that applies pressure above, it is common for the upper layer of material to come out of alignment with the lower layer of material. By marking the seam lines on the material with an embodiment of the present invention, it is contemplated that a user will be able to see if the pieces of material are still in alignment while sewing.

Having fully described at least one embodiment of the present invention, other equivalent or alternative methods of providing a tool for preparing pieces of material to be sewn together according to the present invention will be apparent to those skilled in the art. The invention has been described above by way of illustration, and the specific embodiments disclosed are not intended to limit the invention to the particular forms disclosed. For example, the particular implementation of the guides may vary depending upon the particular type of guides used. The guides described in the foregoing were directed to implementations where multiple guides are located intermittently along an edge of the tool; however, similar techniques are to provide tools with various numbers of guides in various locations along the edges of the tools. For example, without limitation, one embodiment may comprise a single guide along the entire length of the edge of the tool. Another embodiment may comprise a single small guide in the center of the edge of the tool. Yet another alternate embodiment comprises two guides located near the ends of the edge of the tool. Implementations of the present invention with varying guide configurations are contemplated as within the scope of the present invention. The invention is thus to cover all modifications, equivalents, and alternatives falling within the spirit and scope of the following claims.

What is claimed is:

1. An apparatus for preparing material pieces to be sewn together, the apparatus comprising:

a planar structure comprising a top surface, a bottom surface, a first end, a first edge perpendicular to said first end, a second edge perpendicular to said first end and a first width extending from said first edge to said second edge having a dimension of a width for a desired seam allowance, said first edge comprising a first extension extending a first distance below and perpendicular to said bottom surface to form a first lip below said bottom surface where, when the apparatus is placed on a flat surface, the material can be placed between said bottom surface and the flat surface such that an edge of the material aligns with and touches said first lip providing a tactile feedback that the material is aligned and said desired seam allowance can be marked on the material along said second edge, said first end extending away from and perpendicular to said second edge and comprising a third edge at an acute angle to said second edge, said third edge comprising a second extension extending said first distance below and perpendicular to said bottom surface to form a second lip below said bottom surface where, when the apparatus is placed on a flat surface, the material can be placed between said bottom surface and the flat surface such that an angled edge of the material aligns with and touches said second lip and a portion of the material extending beyond said first end can be trimmed.

2. The apparatus as recited in claim 1, wherein said second edge further comprises a third extension extending said first distance below and perpendicular to said bottom surface to form a third lip below said bottom surface where, when the apparatus is placed on a flat surface, the material can be placed between said bottom surface and the flat surface and said third lip holds the material to the flat surface.

3. The apparatus as recited in claim 2, wherein said first and third extensions extend a second distance above said top surface.

4. The apparatus as recited in claim 3, wherein said first and second distances are equal.

5. The apparatus as recited in claim 2, wherein said first extension has a width greater than said third extension.

6. The apparatus as recited in claim 1, wherein said first extension is intermittently spaced along said first edge thereby creating a plurality of extensions and spaces in between where the material can be viewed aligning with and touching said extensions.

7. The apparatus as recited in claim 1, wherein said desired seam allowance is a common width of seam allowance used in quilting.

8. The apparatus as recited in claim 1, wherein said planar structure further comprises a hole in a second end.

9. The apparatus as recited in claim 1, wherein said planar structure comprises a transparent material to facilitate viewing the material.

10. An apparatus for preparing material pieces to be sewn together, the apparatus comprising:

a planar structure comprising a top surface, a bottom surface, a first end and a first and second edge, said first edge comprising a first lip extending a first distance below said bottom surface where an edge of the material aligns with and touches said first lip and the material can be marked along said second edge, said first end being broadened and comprising a third edge at an acute angle to said second edge, said third edge comprising a second lip extending said first distance below said bottom surface where the material having said acute angle aligns with and touches said third lip and a dog ear of the material can be trimmed.

11. The apparatus as recited in claim 10, wherein said second edge further comprises a third lip extending said first distance below said bottom surface for holding the material to a flat surface.

12. The apparatus as recited in claim 11, wherein said first and third lips extend a second distance above said top surface.

13. The apparatus as recited in claim 12, wherein said first and second distances are equal.

14. The apparatus as recited in claim 11, wherein said first lip has a width greater than said third lip.

15. The apparatus as recited in claim 10, wherein said first lip is intermittently spaced along said first edge thereby creating a plurality of lips and spaces in between where the material can be viewed aligning with and touching said extensions.

16. The apparatus as recited in claim 10, wherein said planar structure further comprises a width extending from said first edge to said second edge having a dimension of a width for a desired seam allowance.

17. The apparatus as recited in claim 16, wherein said desired seam allowance is a common width of seam allowance used in quilting.

18. The apparatus as recited in claim 10, wherein said planar structure further comprises a hole in a second end.

19. An apparatus for preparing material pieces to be sewn together, the apparatus comprising:

a planar structure comprising a top surface, a bottom surface, a first edge comprising means for extending below said bottom surface to form a first lip, a second edge parallel to said first edge, and a broadened end comprising a third lip a third edge at an acute angle to said second edge and means for extending below said bottom surface to form a second lip at said third edge.

20. The apparatus as recited in claim 19, wherein said second edge further comprises means for extending below said bottom surface to form a third lip.

* * * * *